US005428195A

United States Patent [19]

Arnold

[11] Patent Number: 5,428,195

[45] Date of Patent: Jun. 27, 1995

[54] CURRENT LIMITER UNIT FOR MOLDED CASE CIRCUIT BREAKERS

[75] Inventor: David Arnold, Chester, Conn.

[73] Assignee: General Electric Company, New York, N.Y.

[21] Appl. No.: 189,614

[22] Filed: Jan. 31, 1994

[51] Int. Cl.[6] ..... H01H 9/42; H01H 33/16

[52] U.S. Cl. ..... 218/1; 361/13; 335/201; 218/22; 218/143

[58] Field of Search ..... 200/144 R, 144 AP, 146 R, 200/147 R, 149 R, 150 R, 151; 361/13, 106; 335/16, 35, 202; 338/21; 337/140, 221

[56] References Cited

U.S. PATENT DOCUMENTS

| | | | |
|---|---|---|---|
| 3,488,761 | 1/1970 | Ito et al. | 337/221 |
| 3,978,300 | 8/1976 | Slade | 200/147 R |
| 4,077,025 | 2/1978 | Slade et al. | 335/16 |
| 4,132,968 | 1/1979 | Lang | 335/16 |
| 4,333,861 | 6/1982 | Aoki et al. | 338/21 |
| 4,375,021 | 2/1983 | Pardini et al. | 200/147 B |
| 4,413,301 | 11/1983 | Middleman et al. | 361/106 |
| 4,485,283 | 11/1984 | Hurtle | 200/144 R |
| 4,513,268 | 4/1985 | Seymour et al. | 335/35 |
| 4,583,146 | 4/1986 | Howell | 361/13 |
| 4,782,583 | 11/1988 | Castonguay et al. | 29/622 |
| 4,965,544 | 10/1990 | Kelaita, Jr. et al. | 335/202 |
| 5,105,178 | 4/1992 | Krumme | 337/140 |
| 5,227,946 | 7/1993 | Jacobs et al. | 361/106 |

*Primary Examiner*—J. R. Scott
*Attorney, Agent, or Firm*—Richard A. Menelly

[57] ABSTRACT

A self-contained current limiter unit allows lower short-circuit-rated circuit breakers to be utilized within industrial applications. The unit is electrically-connected in series with the circuit breakers and the protected load to limit the short circuit current to a fixed predetermined value while the circuit breaker trip unit responds to interrupt the circuit current. A single unit can be arranged in electrical series connection with a plurality of lower short-circuit-rated circuit breakers to allow a substantial savings in component and equipment costs.

5 Claims, 2 Drawing Sheets

CURRENT LIMITER UNIT FOR MOLDED CASE CIRCUIT BREAKERS

BACKGROUND OF THE INVENTION

Industrial-rated circuit breakers such as described within U.S. Pat. No. 4,782,583 entitled "Method of Assembly of a Molded Case Circuit Breaker Crossbar" require operating components that are sized to handle the largest available current during circuit interruption. Since a short circuit available current is only limited by the residual circuit impedance, the circuit breakers within industrial environments are sized to handle short circuit currents which are several orders of magnitude greater than faults occurring because of routine circuit faults that are designated as "long time" or "short time" faults to distinguish from the short circuit faults.

Several attempts have been made to limit the size of the circuit breaker current-carrying components by limiting the short circuit current to a manageable level. One such attempt is in the "arcless" circuit interrupter described within U.S. Pat. No. 4,583,146 entitled "Fault Current Arcless Circuit Interruption" wherein the current is transferred to a voltage variable resistor before contact separation to eliminate the arc that occurs upon contact separation and to rapidly separate the contacts during the early stages of the current waveform.

U.S. Pat. No. 4,375,021 entitled "Rapid Electric Arc Extinguishing" describes the use of so-called "blow open" contact arms to limit the circuit overload current to a reasonable value prior to the articulation of the circuit breaker operating mechanism to interrupt the circuit current.

U.S. Pat. No. 3,488,761 entitled "Current Limiter Device" describes the combination of a positive temperature coefficient material (PTC) in parallel with a metal resistor and in series with a pair of separable contacts to limit the current that is interrupted by the contacts.

U.S. Pat. No. 4,413,301 entitled "Circuit Protection Devices" describes the use of a PTC device in series with a metallic resistor and the separable contacts.

One object of the present invention is to describe a current limiter unit employing a PTC device to assist in limiting short-circuit current to a predetermined value to allow circuit breakers of low short-circuit ratings to be employed within higher rated electrical distribution circuits. Another object of the present invention is to describe a current limiter unit that avoids expenditure of electric power during quiescent current conditions.

SUMMARY OF THE INVENTION

The invention comprises a current limiter unit in the form of a pair of separable contacts connected in parallel with a metallic resistor and a PTC resistor. The current limiter holds the current to a reasonable level upon short circuit to then allow a low short-circuit rated circuit breaker to interrupt the circuit current.

DESCRIPTION OF THE PREFERRED EMBODIMENT

Figure 1:
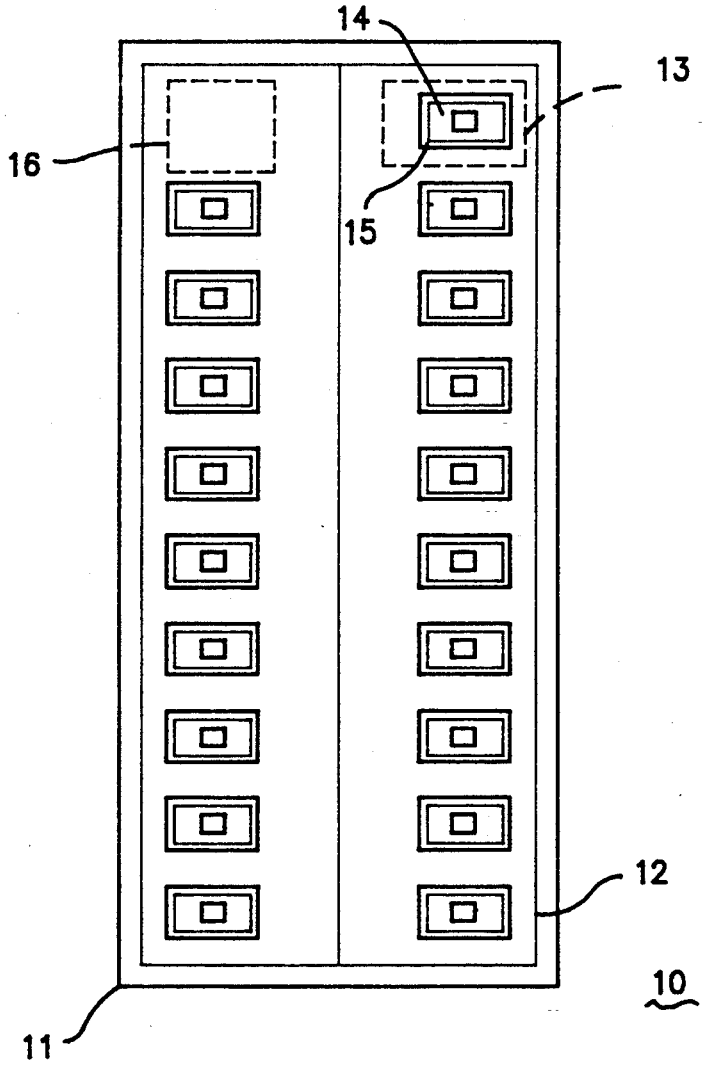
FIG. 1 is a front plan view of a service entrance enclosure containing the current limiting unit in accordance with the invention.

A residential circuit breaker load center 10 is depicted in FIG. 1 and includes an enclosure 11 containing a front access door 12. A series of low ampere rated residential circuit breakers 13 are arranged within the enclosure and are turned ON and OFF by means of operating handles 14 accessible through slots 15 formed within the door 12. One example of a low short-circuit rated residential circuit breaker is found within U.S. Pat. No. 4,513,268 entitled "Automated Q-Line Circuit Breaker". The circuit breakers individually connect between the service entrance line conductors and the associated loads (not shown). The current limiter unit 16 is electrically connected in series with the circuit breakers solely to limit the circuit current upon short circuit overcurrent conditions and to allow the circuit breakers to interrupt the circuit.

Figure 2:
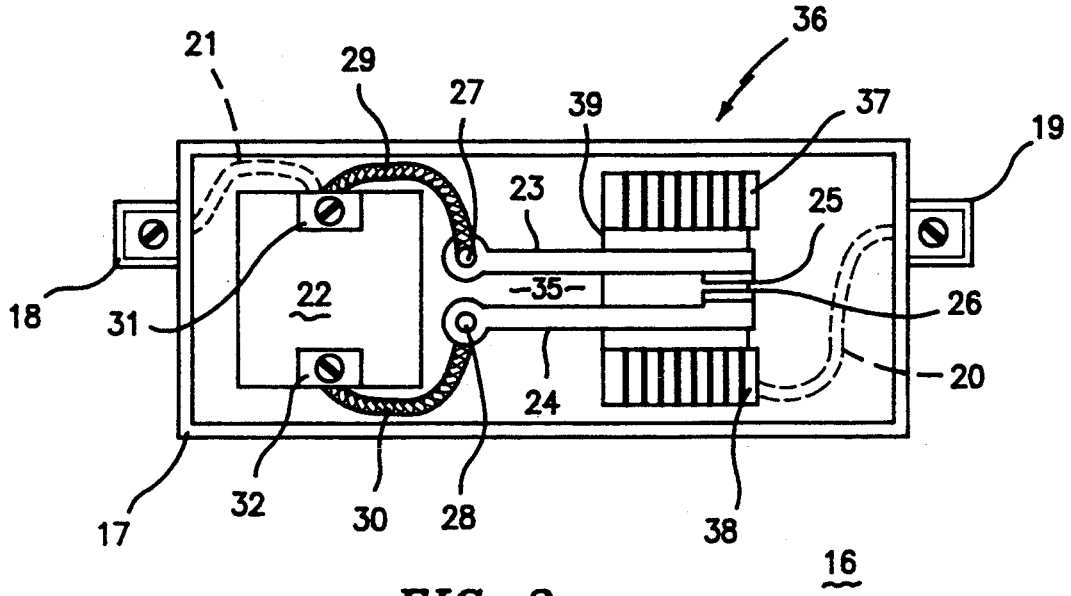
FIG. 2 is an enlarged top perspective view of the current limiter unit of FIG. 1 with the cover removed to detail the operating components.

The current limiter 16 is depicted in FIG. 2 to detail the separable contact arrangement 35 consisting of the movable contact arms 23,24 which are pivotally-attached at one end to the enclosure 17 as depicted at 27,28 and carry the movable contacts 25,26 at an opposite end thereof. The movable contact arms connect with the external circuit by means of the conductors 20, 21 when the current limiter unit is electrically-connected in series with the circuit breakers 13 of FIG. 1 by means of the exterior terminals 18, 19 arranged at opposite ends of the enclosure 17. The movable contact arm arrangement is similar to that described within U.S. Pat. No. 4,485,283 entitled "Current Limiter Unit" wherein the movable contact arms 23,24 are arranged within a slot motor 36 consisting of a pair of transformer core laminations 37, 38 joined by a bight 39. When the current through the contact arms exceeds a predetermined value, the opposing magnetic forces generated within the contact arms blow the contact arms apart and cause the movable contacts 25,26 to become separated. Unlike the current limiter described within the aforementioned U.S. Pat. No. 4,485,283 a transfer circuit 22 is electrically-connected in parallel with the movable contact arms 23,24 by means of the braid conductors 29,30, and terminals 31,32 minimize the occurrence of an arc when the movable contacts become separated.

The resistance of the movable contacts 25,26 is in the order 20 to 80 of micro-ohms which is relatively low compared to the higher resistance through the parallel transfer circuit 22. Upon contact separation, the current transfers through the transfer circuit and becomes limited in the manner to be described below in some detail.

Figure 4:
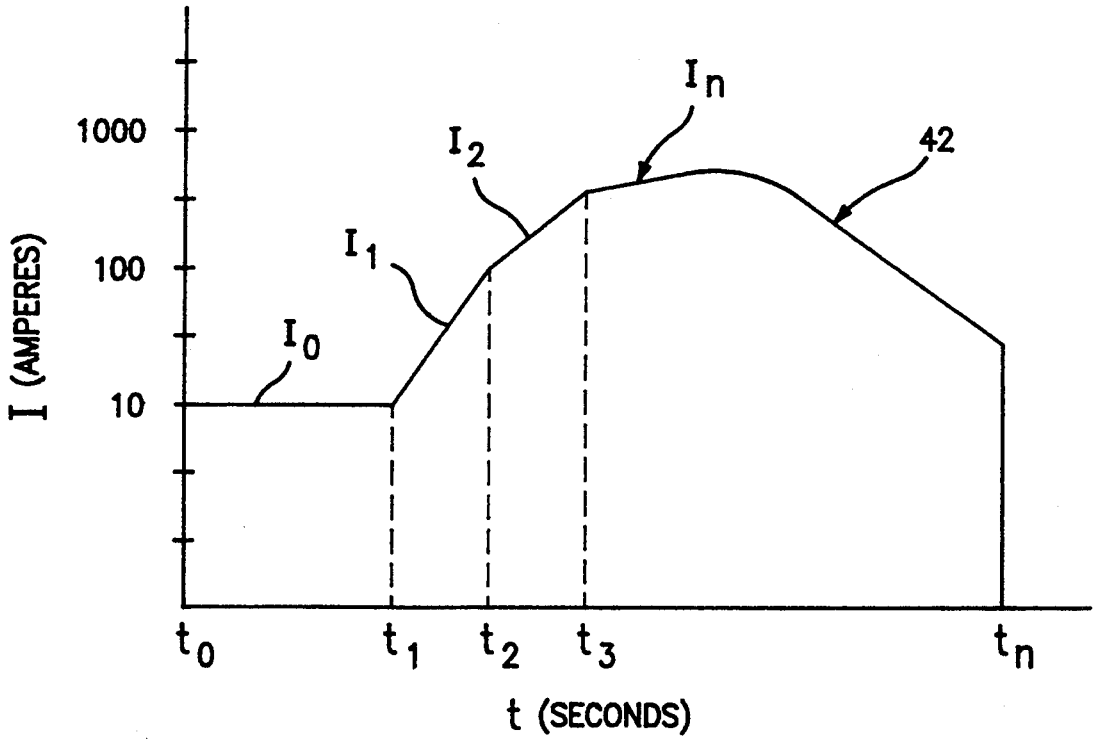
FIG. 4 is a graphic representation of the current transport within the current limiter of FIG. 2.
Figure 3:
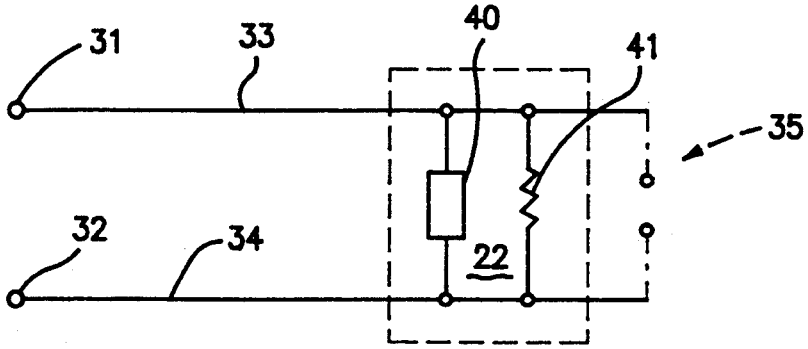
FIG. 3 is diagrammatic representation of the circuit components within the transfer circuit of FIG. 2.

The components within the transfer circuit 22 are shown in FIG. 3 to consist of a PTC unit 40 electrically connected in parallel to a metallic resistor 41 by means of rails 33, 34 which terminate at terminals 31,32. The separable contact arrangement 35 is depicted in phantom to show the parallel connection with PTC and metallic resistor. The circuit current that transports between terminals 31,32 is limited solely by the low contact resistance described earlier. When the current increases by short circuit fault, the contacts separate and the current transfers through the parallel combination of the PTC and the metallic resistor. Since the temperature of the PTC is at a low initial value, which is lower than the so-called "cold" resistance of the metallic resistor, the current transfers mainly through the PTC which becomes heated in the process. One example of a PTC material is the conductive polymer described within the aforementioned U.S. Pat. No. 4,413,301 entitled "Circuit Protection Devices Comprising PTC Element". Once the PTC is at an elevated temperature caused by resistance heating, the current then transfers to the metallic resistor which is now at a lower resistance than the heated PTC. The metallic resistor consisting of tantalum or tungsten alloys is able to sustain the higher current and associated temperature and forces the current to a predetermined value depending on the selected operating temperature of the metallic resistor. The current is then limited by the resistance value of the resistor and is prevented from further increase. The enclosure can be heat-sinked to a large metallic substrate of aluminum, copper or other material of high specific heat and high thermal conductivity to insure the predetermined operating characteristics of the current limiter unit if so desired. The automatic transfer of the current from the contacts to the PTC and metallic resistor is best seen by referring now to the current profile 42 depicted in FIG. 4.

The circuit current proceeds along the profile 42 from the quiescent current $I_0$ within the steady state design of the circuit breakers shown earlier in FIG. 1. Upon occurrence of a short circuit at $t_1$, the movable contact arms 23,24 of FIG. 2 are blown open by the rising current $I_1$ and the associated movable contacts 25, 26 become rapidly separated at $t_2$. The current then transfers to the PTC and increases along the current ramp depicted at $I_2$ until the current mainly transfers over to the metallic conductor at $t_3$ and follows the current wave form depicted at In. The current value In represents the current value as limited primarly by the resistance of the PTC and continues to be limited until the associated circuit breaker operates to interrupt the current at $t_n$.

A current limiter device has been described wherein a PTC device is electrically-connected in parallel with a pair of separable contacts and a metallic resistor. The current limiter allows low rated circuit breakers to be employed within higher rated electric circuits by limiting the short circuit current to a predetermined value.

I claim:

1. A current limiter comprising:

an enclosure;

a pair of contact arms within said enclosure arranged within a magnetic slot motor for automatic separation upon occurrence of overcurrent conditions through said contact arms;

a pair of contacts, one of said contacts being arranged on one end of one of said contact arms for transport of circuit current between said contacts upon quiescent current conditions, and for transfer of circuit current when said contact arms become separated;

a PTC device within said enclosure electrically-connected with said contact arms; and an ohmic resistor within said enclosure electrically-connected with said PTC device andsaid contact arms whereby circuit current transfers from said contacts to said PTC device and said ohmic resistor when said contacts become separated.

2. The current limiter of claim 1 wherein said PTC device comprises a conductive polymer.

3. The current limiter of claim 1 wherein said ohmic resistor comprises tungsten or tantalum.

4. The current limiter of claim 1 further including a circuit breaker electrically connected in series with said contacts, said PTC and said ohmic resistor.

5. An economic circuit breaker load center comprising:

an enclosure;

a pair of movable contact arms within said enclosure arranged within a magnetic slot motor for automatic separation by means magnetic repulsion upon occurrence of overcurrent conditions through said movable contact arms;

a pair of movable contacts, one of said movable contacts being arranged on one end of one of said movable contact arms for transport of circuit current between said contacts upon quiescent current conditions, and for interruption of circuit current when said movable contact arms become separated;

a PTC device within said enclosure electrically-connected with said moveable contact arms;

an ohmic resistor within said enclosure electrically-connected with said PTC device and said moveable contact arms whereby circuit current transfers from said contacts to said PTC device and said ohmic resistor when said contacts become separated and;

a plurality of circuit breakers within said enclosure, each of said circuit breakers being arranged for connection with an associated electric circuit, each of said circuit breakers being electrically connected with said contacts, said ohmic resistor and said PTC device.

* * * * *